US005512703A

United States Patent [19]

Usa

[11] Patent Number: 5,512,703

[45] Date of Patent: Apr. 30, 1996

[54] ELECTRONIC MUSICAL INSTRUMENT UTILIZING A TONE GENERATOR OF A DELAYED FEEDBACK TYPE CONTROLLABLE BY BODY ACTION

[75] Inventor: Satoshi Usa, Hamamatsu, Japan

[73] Assignee: Yamaha Corporation, Japan

[21] Appl. No.: 35,631

[22] Filed: Mar. 23, 1993

[30] Foreign Application Priority Data

Mar. 24, 1992 [JP] Japan ..... 4-097021

[51] Int. Cl.[6] ..... G10H 7/00

[52] U.S. Cl. ..... 84/600; 84/659

[58] Field of Search ..... 84/600, 622, 626, 84/644, 659, 670

[56] References Cited

U.S. PATENT DOCUMENTS

| | | | |
|---|---|---|---|
| 5,022,303 | 6/1991 | Suzuki et al. | 84/600 |
| 5,278,350 | 1/1994 | Okamoto et al. | 84/658 |
| 5,286,913 | 2/1994 | Higashi | 84/622 |
| 5,290,966 | 3/1994 | Aoki | 84/636 |

FOREIGN PATENT DOCUMENTS

| | | |
|---|---|---|
| 2-294692 | 12/1990 | Japan . |
| 3-8398 | 1/1991 | Japan . |
| 3-145696 | 6/1991 | Japan . |
| 3-145695 | 6/1991 | Japan . |
| 3-164798 | 7/1991 | Japan . |
| 3-164797 | 7/1991 | Japan . |
| 3-161798 | 7/1991 | Japan . |
| 3-161799 | 7/1991 | Japan . |
| 4-242795 | 8/1992 | Japan . |

*Primary Examiner*—William M. Shoop, Jr.
*Assistant Examiner*—Jeffrey W. Donels
*Attorney, Agent, or Firm*—Graham & James

[57] ABSTRACT

The electronic musical instrument includes a detecting unit, an excitation signal generator and a tone generator. The detecting unit detects body action to produce an action signal representative of the detected body action. The detecting unit includes a sensor element directly attached to a given part of a player's body for detecting the body action of that part. The excitation signal generator produces an excitation signal according to the action signal. The tone generator is one of a delayed feedback type, receives the excitation signal, and generates a musical tone signal according to a designated tone pitch. The tone generator includes a delay element for delaying the excitation signal by a given time corresponding to the designated tone pitch, and a feedback path for feeding back the delayed excitation signal to the delay element.

11 Claims, 12 Drawing Sheets

| | | LFS | MAX | | | |
|---|---|---|---|---|---|---|
| | | | 2 | 3 | 4 | 5 |
| PA | I | 1 | B3 | A3 | G3 | F3 |
| | | 0 | C4 | A3# | G3# | F3# |
| | II | 1 | F3 | E3 | D3 | C3 |
| | | 0 | F3# | F3 | D3# | C3# |
| | III | 1 | B2 | A2 | G2 | F2 |
| | | 0 | C3 | A2# | G2# | F2# |
| | IV | 1 | F2 | E2 | D2 | C2 |
| | | 0 | F2# | F2 | D2# | C2# |
| | V | 1 | B1 | A1 | G1 | F1 |
| | | 0 | C2 | A1# | G1# | F1# |

ELECTRONIC MUSICAL INSTRUMENT UTILIZING A TONE GENERATOR OF A DELAYED FEEDBACK TYPE CONTROLLABLE BY BODY ACTION

BACKGROUND OF THE INVENTION

The present invention relates to an electronic musical instrument utilizing a tone generator of a delayed feedback type, and more specifically relates to control technology for efficiently operating the tone generator to full extent of its expressive ability of musical sound. There has been known a conventional tone generator composed of an electronic loop circuitry which simulates a sounding mechanism of an acoustic musical instrument. For example, Japanese Patent Application Laid-open No. 294692/1990 discloses a tone generator simulating a sounding mechanism of a wind instrument. Japanese Patent Application Laid-open No. 161799/1991 discloses another tone generator simulating a sounding mechanism of a stringed instrument. These conventional tone generators are constructed commonly of a delay element and a feedback path for returning a delayed signal to the delay element, and therefore are called "delayed feedback type". The tone generator of the delayed feedback type is utilized not only to simulate various acoustic instruments, but also to synthesize an artificial musical tone which is newly created by the electronic musical instrument based on the principle of delayed feedback loop synthesis. While other conventional tone generators of a waveform memory type or an FM type basically operate to increment an address of a waveform memory by a given speed to read out a desired tone waveform, the above noted tone generator of the delayed feedback type is operated basically by inducing an oscillation in a closed loop formed by the delay element and the feedback path. Therefore, an external input of a certain excitation signal is required for exciting the closed loop. A delicate variation of the excitation signal could impart significant artistic expression to the synthesized musical tone. For example, in the electronic musical instrument disclosed in the first-mentioned prior art reference, an excitation signal is torn-ted according to initial and after touch data inputted by means of a keyboard and additional data inputted by means of a mouse controller. In case of the second-mentioned prior art, an excitation signal is formed based on manipulation information of a joystick.

These of mouse controller and joystick are provided to supplement a keyboard which is difficult to input diverse and delicate performance manner. However, the mouse controller and joystick have rather a mechanical and rigid construction, and therefore are not suitable for inputting expressive and flexible performance manner, thereby failing to derive full ability from the tone generator of the delayed feedback type.

SUMMARY OF THE INVENTION

In view of the above noted drawbacks of the prior art, a first object of the present invention is to efficiently operate the tone generator of the delayed feedback type to its full extent of synthesis ability to thereby enable artistic, impressive and expressive performance in an electronic musical instrument. Additionally, a second object of the invention is to impart variety to the musical performance.

According to the first aspect of the invention, an electronic musical instrument comprises detecting means for detecting body action to produce an action signal representative of the detected body action, the detecting means including sensor means directly attached to a given part of a player's body for detecting the body action of that part, excitation means for producing an excitation signal according to the action signal, pitch means for designating a desired tone pitch, and tone generator means of the delayed feedback type receptive of the excitation signal for generating a musical tone signal according to the designated tone pitch, the tone generator means including delay means for delaying the excitation signal by a given time corresponding to the designated tone pitch and feedback means for feeding back the delayed excitation signal to the delay means.

According to the second aspect of the invention, an electronic musical instrument comprises detecting means for detecting a body action of a player to produce an action signal indicative of the detected body action, pitch means for designating a given pitch of a musical tone, timing means responsive to the action signal for producing a timing signal indicative of initiation and/or termination of a musical tone, function means responsive to the timing signal for producing a time-varying signal which varies according to the initiation and/or termination of a musical tone, synthesis means for processing the time-varying signal based on the action signal so as to form an excitation signal, and tone generator means of the delayed feedback type excited by the excitation signal for generating a tone signal representative of the musical tone according to the designated pitch, the tone generator means including delay means for delaying the excitation signal by a given time corresponding to the designated pitch and feedback means for feeding back the delayed excitation signal to the delay means.

In operation of the first inventive instrument, the detecting means directly attached to a given part of the player's body produces an action signal in response to the player's body action. The pitch means designates a certain tone pitch. The tone generator means composed of a loop circuit of the delay means and the feedback means receives an excitation signal which is formed according to the action signal, so that the loop circuit is excited. In the loop circuit, the delay means imparts a given delay time determined by the designated tone pitch, to a signal circulating through the loop circuit, thereby generating a desired musical tone signal.

In operation of the second inventive instrument, the detecting means attached to a given part of the player's body produces an action signal in response to the player's body action. The pitch means designates a certain pitch of a musical tone. The timing means produces a timing signal indicative of initiation and/or termination of a musical tone in response to the action signal. The function means produces a time-varying signal in response to the timing signal. The synthesis means processes the time-varying signal with the action signal to produce an excitation signal. The tone generator means including a loop circuit of the delay means and the feedback means receives the excitation signal effective to oscillate the loop circuit. In the loop circuit, the delay means delays a signal circulating the loop circuit by a given delay time corresponding to the designated pitch, thereby generating a desired tone signal representative of the musical tone.

DETAILED DESCRIPTION OF THE INVENTION

Figure 1:
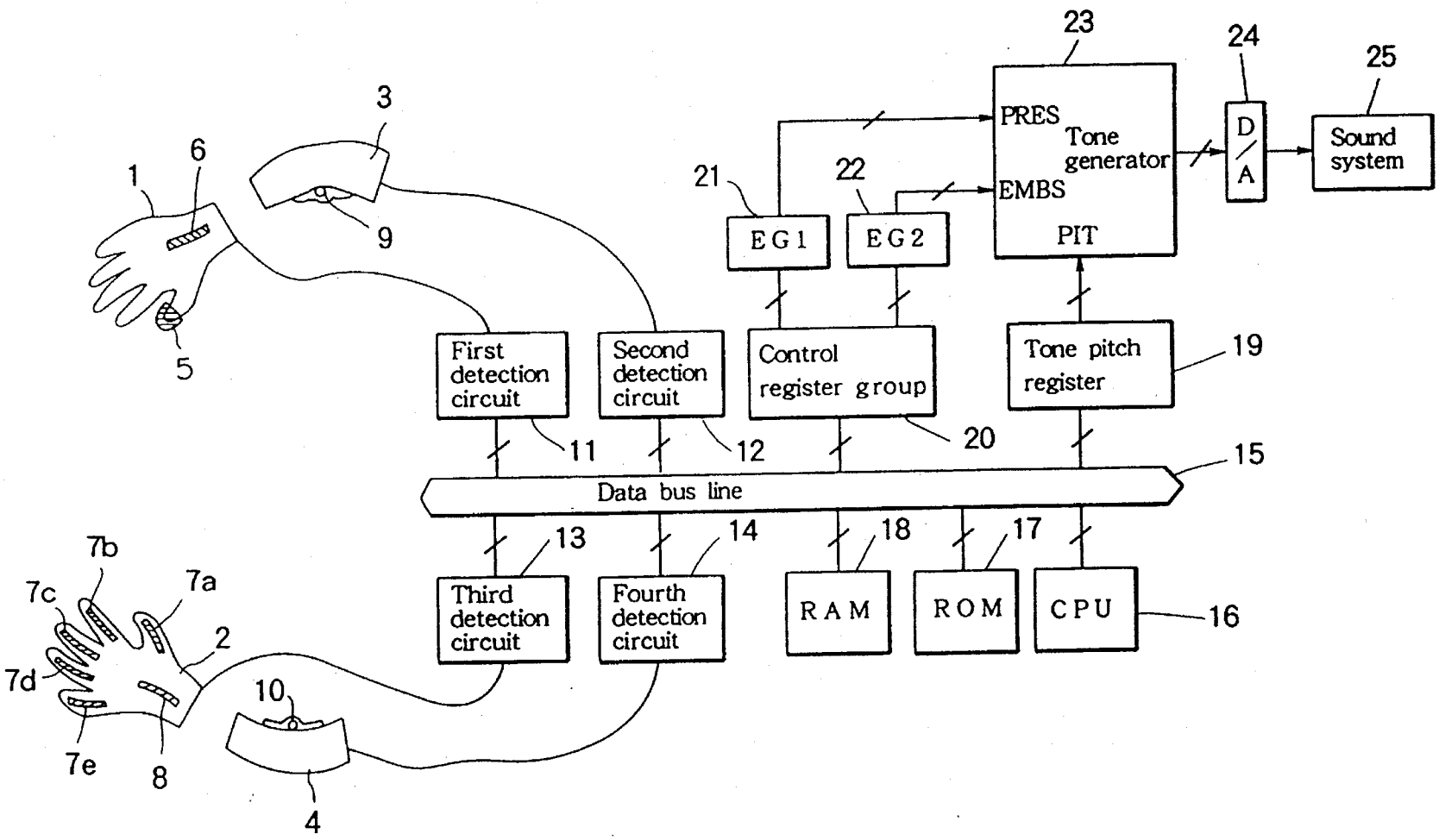
FIG. 1 is a block diagram showing an overall construction of one embodiment of the electronic musical instrument according to the invention.

FIG. 1 is a block diagram showing overall construction of an electronic musical instrument according to the invention. The instrument utilizes a pair of flexible attachments 1, 2 having a glove-like shape and being fitted to right and left hands of a player. The right hand attachment 1 is provided with a pressure sensor 5 for sensing a pressure applied by the thumb of the right hand, and a right wrist sensor 6 for sensing a bend angle of the wrist of the right hand. The left hand attachment 2 is provided with a plurality of left finger sensors 7*a*–7*e* for sensing bend angles of thumb, forefinger, middle finger, third finger and little finger of the left hand, respectively. The left hand attachment 2 is further provided with a left wrist sensor 8 for sensing a bend angle of the wrist of the left hand. These of the left finger sensors 7*a*–7*c* and the right and left wrist sensors 6, 8 are of the type utilizing a resistive sensor element in which an electric resistance varies according to the bend angle. The detailed structure thereof is disclosed, for example, in Japanese Patent Application Laid-open No. 242795/1992.

The instrument utilizes another pair of flexible attachments 3, 4 having a sleeve-like shape fitted to the right and left elbows of the player. The elbow attachments 3, 4 are provided with a fight elbow sensor 9 and a left elbow sensor 10, respectively, for sensing a bend angle of the corresponding elbows. The elbow sensors 9, 10 are of the type utilizing a variable resistor which varies its electric resistance according to the elbow bend angle. The detailed structure thereof is disclosed, for example, in Japanese Utility Model Application Laid-open No. 8398/1991.

These of the sensor elements 5, 6, 7*a*–7*e* and 8–10 are connected to detection circuits 11–14. These detection circuits 11–14 are connected to a central processing unit (CPU) 16 through a data bus line 15. The detection circuits 11–14 are composed of an A/D converter and other components for converting an analog output of the sensor elements into a corresponding digital signal which is ted to the CPU 16. The CPU 16 is connected through the data bus line 15 to those of read-only memory (ROM) 17, random access memory (RAM) 18, tone pitch register 19 and control register group 20. The ROM 17 stores a program executed in the CPU 16, and the RAM 18 is utilized for temporarily storing various data during the course of digital processing in the CPU 16. The tone pitch register 19 is connected to a tone generator 23 for temporarily registering a tone pitch data PIT inputted from the CPU 16 and for feeding the same to the tone generator 23. The control register group 20 is connected to a pair of first and second envelope generators (EG1, EG2) 21, 22 for temporarily registering various control data inputted from the CPU 16 and for feeding the same to the envelope generators 21, 22.

The first and second envelope generators 21, 22 are connected to the tone generator 23 for feeding excitation signals in the form of a mouth pressure signal PRES and an embouchure signal EMBS, respectively. In this embodiment, the electronic musical instrument is designed to generate a musical tone which simulates a natural tone of an acoustic wind instrument such as a saxophone. The mouth pressure signal PRES represents a blowing pressure in playing of an wind instrument, and the embouchure signal EMBS represents an embouchure such as lip action in playing of an wind instrument. The tone generator 23 generates a musical tone signal according to the inputted excitation signals PRES, EMBS and the tone pitch data PIT, and feeds the musical tone signal to a sound system 25 through a D/A converter 24. The sound system 25 is composed of an amplifier, a speaker and so on for sounding a musical tone according to the musical tone signal. According to the FIG. 1 construction, the CPU 16 determines various tone control parameters based on the hand and arm action of the player such as a pressure applied by the right hand thumb (hereinafter, referred to as "right thumb pressure"), bend angles of the left hand fingers, bend angles of the right and left wrists, and bend angles of the right and left elbows. The envelope generators 21, 22 and the tone generator 23 are controlled by the determined parameters so as to effect generation of musical tones in response to the hand and arm action of the player.

Figure 2:
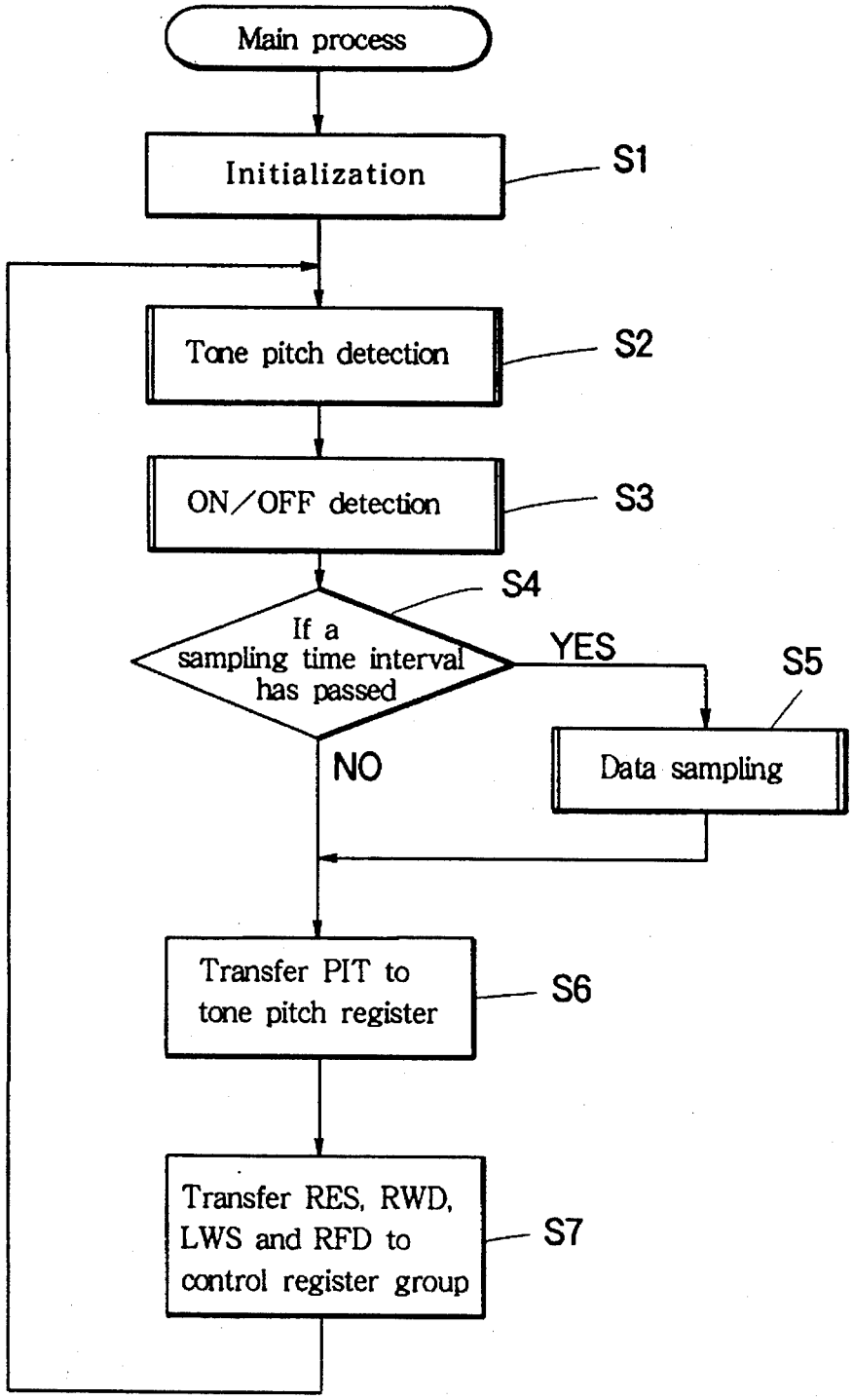
FIG. 2 is a flowchart showing a main routine process executed by CPU in the electronic musical instrument.
Figure 3:
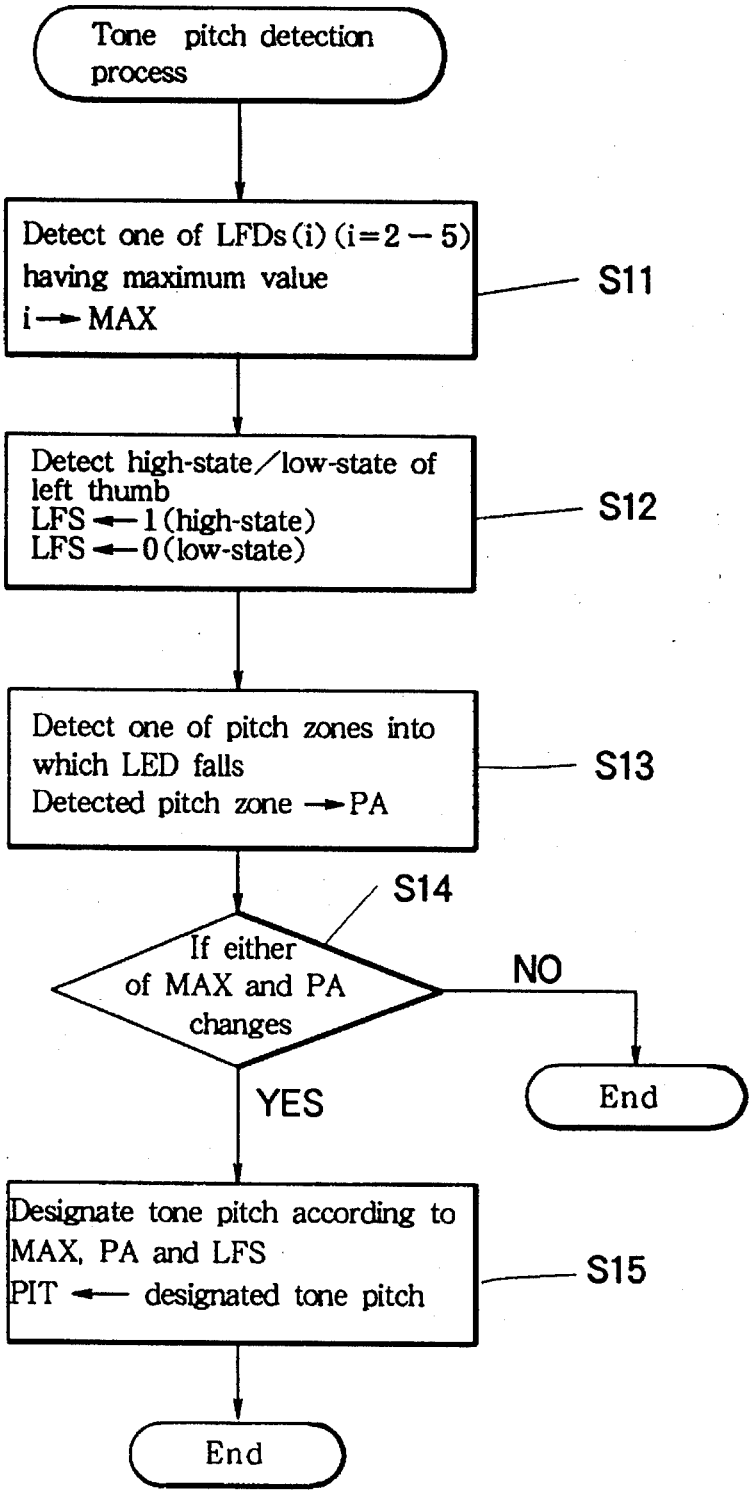
FIG. 3 is a flowchart showing a subroutine of tone pitch detection process.
Figure 5:
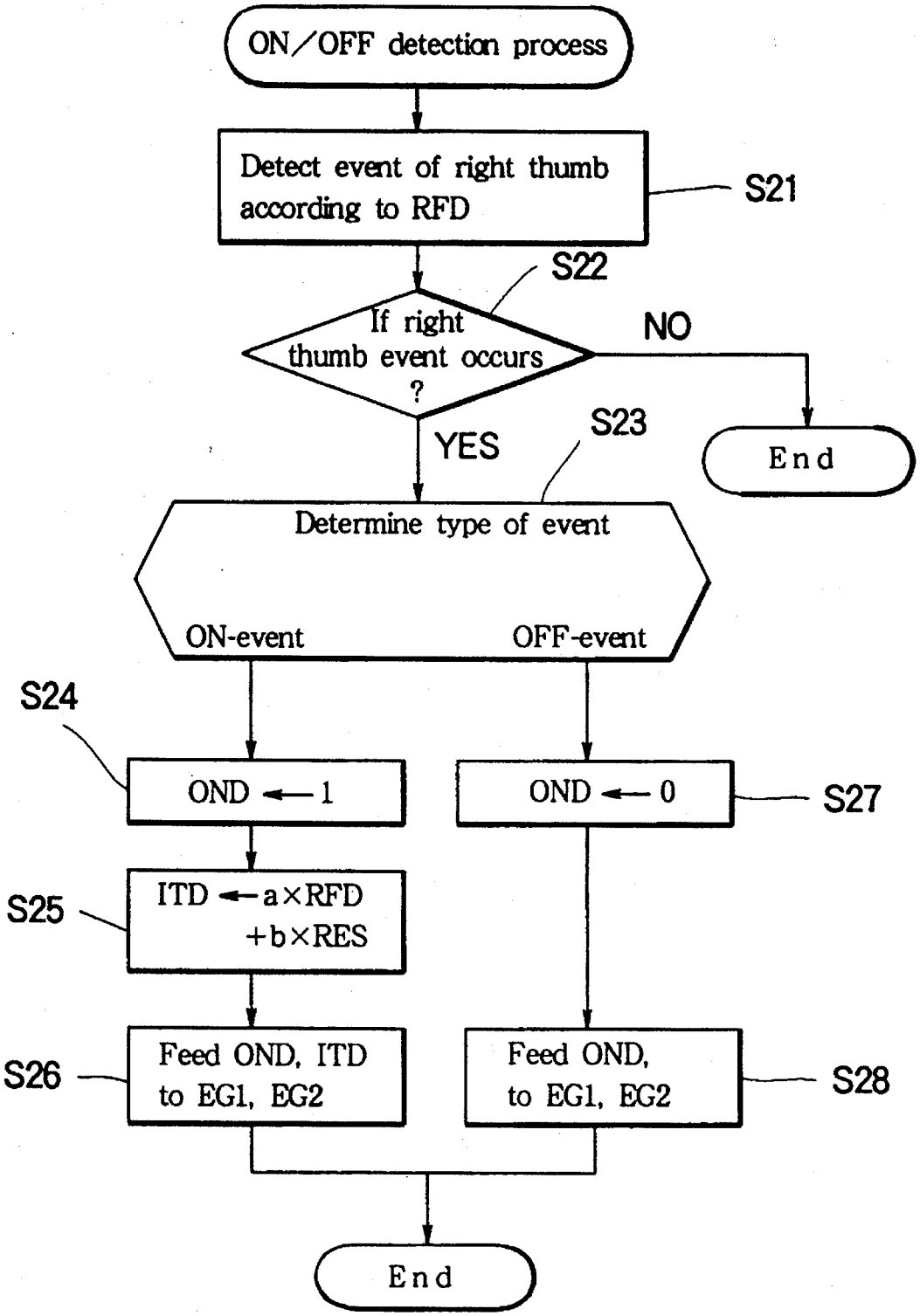
FIG. 5 is a flowchart showing a subroutine of ON/OFF detection process of the body action.

FIG. 2 is a flowchart of a main process routine executed by the CPU 16 for determining the tone control parameters. Firstly, Step S1 is undertaken for initialization of various parameters. Then, Step S2 is undertaken to execute a subroutine of tone pitch detection (a detail of which is shown in FIG. 3). Subsequently, Step S3 is undertaken to execute another subroutine of ON/OFF detection (a detail of which is shown in FIG. 5). In the tone pitch detection subroutine, the tone pitch data PIT is computed according to bend angles LFD (i) of the left hand fingers where i denotes digit numbers "1"–"5" corresponding to thumb, forefinger, middle finger, third finger and little finger, and according to a bend angle LED of the left elbow. In the ON/OFF detection subroutine, an ON/OFF timing signal OND is determined according to the right thumb pressure RFD. Additionally, an initial touch data ITD is computed according to the right thumb pressure RFD and a right elbow bending speed RES (which is calculated in following Step S5).

Figure 7:
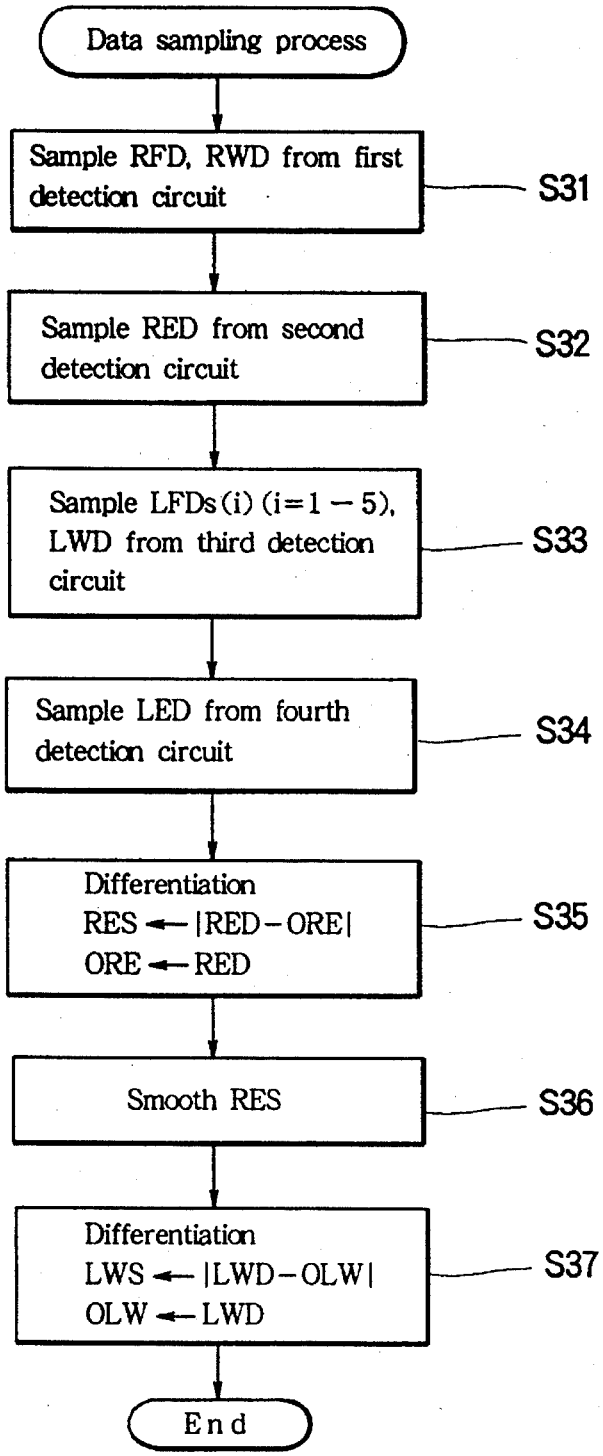
FIG. 7 is a flowchart showing a subroutine of data sampling process.

In subsequent Step S4, judgement is made as to if a predetermined sampling time interval (for example, 2–3 msec) has passed from a previous execution time of Step S5. If YES, processing advances to Step S5. If NO, processing advances to Step S6. In Step S5, a data sampling subroutine (a detail of which is shown in FIG. 7) is executed. In this subroutine, the detection results of the body action are read out from the detection circuits 11–14 to compute a variation amount of the fight elbow bend angle RED, which denotes a right elbow bending speed RES, and another variation amount of the left wrist bend angle LWD, which denotes a left wrist bending speed LWS. Then, Step S6 is undertaken to transfer the tone pitch data PIT to the tone pitch register 19. Further, Step S7 is undertaken to transfer to the control register group 20, action signals in the form of various control parameters including the right elbow bending speed RES, right wrist bend angle RWD, left wrist bending speed LWS and right thumb pressure RFD, thereafter returning to Step S2.

Next, respective processes of the above noted subroutines are explained in conjunction with FIGS. 3–7. Referring to FIG. 3 of the tone pitch detection subroutine, Step S11 is undertaken to detect one of the left finger bend angles LFDs (i) (i=2–5), which has a maximum value, and to designate the corresponding digit number i as a bend angle maximum digit number MAX. The MAX is selected from four digit numbers i=2–5 corresponding to forefinger, middle finger, third finger and little finger, except thumb (i=1). Subsequent Step S12 is undertaken to detect if the left thumb bend angle LFD (1) exceeds a predetermined angle. In case that the LFD (1) exceeds the predetermined angle, a high-state is set. In case that the LFD (1) is less than the predetermined angle, a low-state is set. Then, a left thumb state flag LFS is set to "1" in case of the high-state, or the same LFS is set to "0" in case of the low-state.

Figures 4A, 4B:
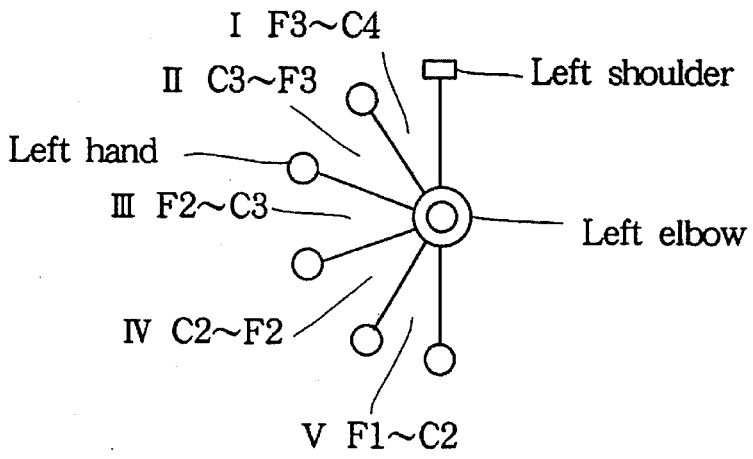
FIGS. 4A and 4B are an explanatory diagram showing relation between a sequence of player's body action and a designated tone pitch.

Next. Step S13 is undertaken to detect one of five pitch zones I, II, III, IV and V (FIG. 4A) into which the left elbow bend angle LED falls. The detected pitch zone is represented by a pitch zone code PA. As shown in FIG. 4A, the pitch zones are assigned corresponding to angularly divided sections around the left elbow. Then, Step S14 is undertaken to check as to if either of the bend angle maximum digit number MAX and the pitch zone code PA is changed. If there is no change, the subroutine is finished. If there is a change, processing advances to Step S15. In Step S15, a pitch of the musical tone to be generated is designated as the current tone pitch data PIT according to those of the bend angle maximum digit number MAX, pitch zone code PA and left thumb state flag LFS. Namely, one of key codes F1–C4 is determined as shown in FIG. 4B. For example, in the pitch zone I, when the left thumb is held in the high-state (LFS=1) and the left little finger is bent most deeply (MAX=5), a note F3 is designated. Alternatively, when the fourth finger is bent most deeply (MAX=4), another note G3 is designated. In similar manner, when the middle finger is bent most (MAX=3), a note A3 is determined. When the forefinger is bent most (MAX=2), a note B3 is determined. As described above, in the tone pitch detection subroutine, the tone pitch data PIT is computed based on the finger bend angles LFDs (i) of the left hand and the elbow bend angle LED of the left hand.

Figure 6:
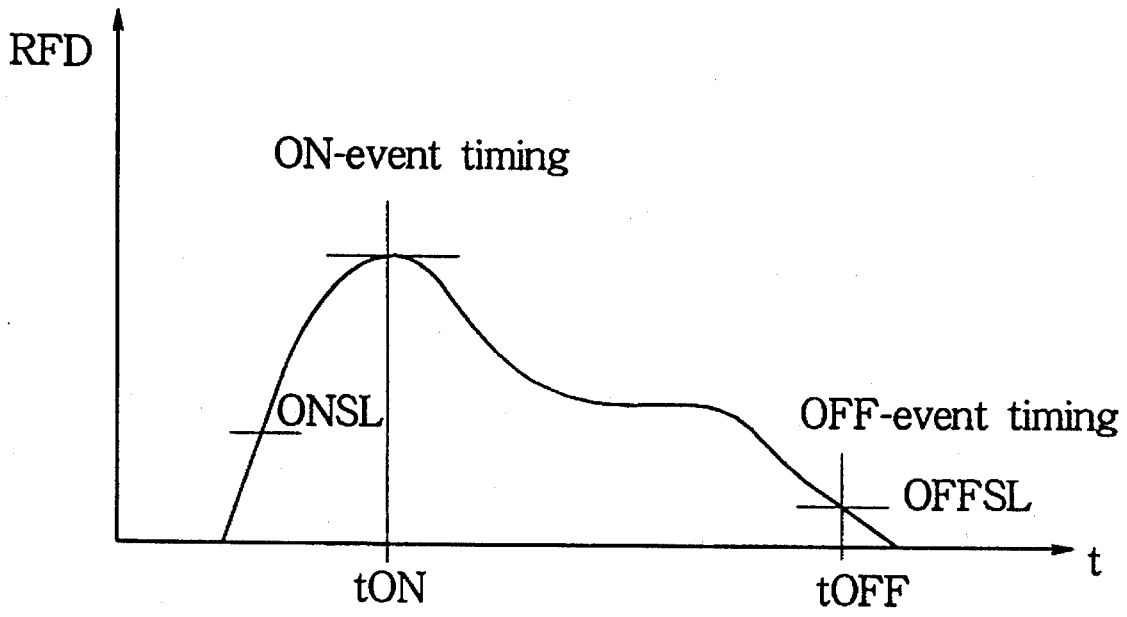
FIG. 6 is an illustrative diagram showing determination of ON-event timing (tON) and OFF-event timing (tOFF).

Referring next to FIG. 5 showing a flowchart of the ON/OFF detection subroutine executed in Step S3 of FIG. 2, firstly Step S21 is undertaken to detect an event of the right hand thumb according to the right thumb pressure RFD. Namely, as shown in FIG. 6, an ON-event is detected when continuous increase in RFD is stopped after RFD exceeds a given ON-threshold value ONSL, and a moment of the ON-event is detected as an ON-event timing tON. Further, an OFF-event is detected when continuously decreasing RFD reaches another given threshold value OFFSL, and a moment of the OFF-event is detected as an OFF-event timing tOFF. Subsequent Step S22 is undertaken to check as to if the right thumb event has occurred. If the check result is found NO, this subroutine is finished. On the other hand that the check result is held YES, next Step S23 is undertaken to determine a type of the event. In case of the ON-event, an ON/OFF timing signal OND is set to "1" in Step S24. Further, Step S25 is undertaken to compute the initial touch data ITD according to the following relation (1):

$$ITD=a\times RFD+b\times RES$$

where RES denotes the right elbow bending speed which is computed by the later described FIG. 7 data sampling subroutine, and "a" and "b" denote given constants. In the relation (1), the value of RFD is set to its maximum observed at the ON-event timing tON. According to the relation (1), the initial touch data ITD is set based on the maximum value of the right thumb pressure RFD and the right elbow bending speed RES. The thus computed ITD is led to the envelope generators 21, 22 together with the timing signal OND at Step S26. On the other hand that the OFF-event has occurred, Step S27 is undertaken to set the ON/OFF timing signal OND to "0". Then, in Step S28, the ON/OFF timing signal OND is fed to the envelope generators 21, 22. The thus obtained ON/OFF timing signal OND has a logic level indicative of initiation and/or termination of a musical tone, as shown in a first waveform (a) of FIG. 10. As described above, the ON/OFF detection subroutine is carried out to set the ON/OFF timing signal OND based on the right thumb pressure RFD, and to calculate the initial touch data ITD based on the right thumb pressure RFD and the right elbow bending speed RES.

Referring to FIG. 7 which shows a flowchart of the data sampling subroutine executed in Step S5 of the FIG. 2 main routine, firstly Step S31 is undertaken to retrieve an action signal in the form of the right thumb pressure RFD and the right wrist bend angle RWD from the first detection circuit 11. In similar manner, Step S32 is undertaken to retrieve or sample the right elbow bend angle RED from the second detection circuit 12. Step S33 is undertaken to sample the left finger bend angles LFDs (i) (i=1–5) and the left wrist bend angle LWD from the third detection circuit 13. Step S34 is undertaken to sample the left elbow bend angle LED from the fourth detection circuit 14. In subsequent Step S35, the right elbow bending speed RES is computed according to the following differential relation (2):

$$RES=|RED-ORE| \quad (2)$$

where ORE denotes an old value of RED, which has been sampled in previous Step S32 of this subroutine. After the differential computation of the relation (2), the present value of RED is reserved as a next ORE. Then, Step S36 is undertaken to effect smoothing process of the RES value which is computed according to the relation (2). The processed result is set as the final right elbow bending speed RES. The smoothing process is carried out by, for example, averaging calculation of consecutive RES values. In manner similar to Step S35, Step S37 is undertaken to compute the left wrist bending speed LWS according to the following differential relation (3):

$$LWS=|LWD-OLW| \quad (3)$$

where OLW is an old value of LWD, and is replaced by the current value of LWD after the differential computation of the relation (3). As described above, the data sampling subroutine is executed to sample primary action signals provided by the various hand and arm action sensors, and to compute secondary action signals such as the right elbow bending velocity RES and the left wrist bending velocity LWS according to the sampled primary action signals. The parameters RES, RWD, LWS and RFD processed in this subroutine are fed to the control register group 20 so as to control the first and second envelope generators, as will be described later in detail.

Figure 8:
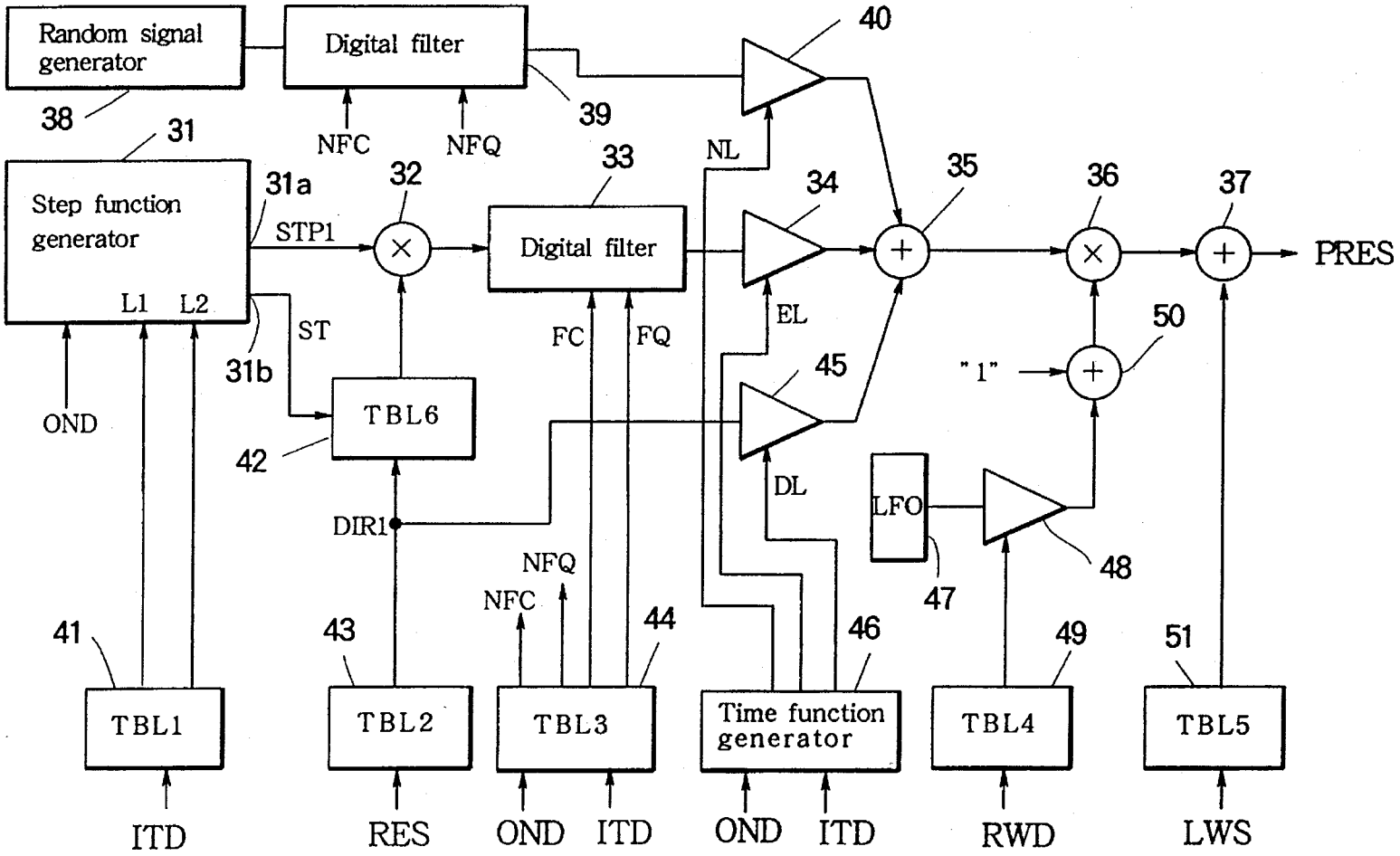
FIG. 8 is a block diagram showing construction of a first envelope generator (EG1).

Next, the description is given for excitation means in the form of the first and second envelope generators 21, 22 in conjunction with FIGS. 8–11. Referring first to FIG. 8 which is a block diagram of the first envelope generator 21, a step function generator 31 is provided to generate a time-varying signal in the form of a step signal STP1 as shown in a waveform (e) of FIG. 10. A step signal output terminal 31*a* of the generator 31 is connected to an adder 35 through a multiplier 32, a digital lowpass filter 33 and another multiplier 34. A random signal generator 38 is separately provided to generate, for example, a white noise. An output terminal of the generator 38 is connected to the adder 35 through a digital bandpass filter 39 and a multiplier 40. The digital bandpass filter 39 may be replaced by digital lowpass filter or highpass filter.

The step function generator 31 receives directly the ON/OFF timing signal OND, and receives control parameters L1 and L2 from a first data converter (TBL1) 41. The first data converter 41 is inputted with the initial touch data ITD for determining values of the control parameters L1, L2 according to the ITD value. As shown in the waveform (e) of FIG. 10, the control parameters L1, L2 are effective to determine an amplitude of the step signal. A state signal output terminal 31*b* of the step function generator 31 is connected to a sixth data converter (TBL6) 42 to feed thereto a state signal ST. As shown in the waveform (e) of FIG. 10, the state signal ST takes sequentially value "0" prior to the ON-timing tON, value "1" between the ON-timing tON and an intermediate timing t2, value "2" between the intermediate tin-ting t2 and a last timing t3, and value "0" after the last timing t3. A second data converter (TBL2) 43 receives the right elbow bending speed RES, and its output terminal is connected to the sixth data converter 42 and to a multiplier 45, an output of which is fed to the adder 35. A third data converter (TBL3) 44 receives the ON/OFF timing signal OND and the initial touch data ITD, and an output terminal thereof is connected to the digital filters 33, 39. The third data converter 44 operates based on the OND and ITD for determining cutoff frequency control parameters FC, NFC effective to control cutoff frequencies of the digital filters 33, 39, respectively, and for determining resonance control parameters FQ, NFQ effective to control resonance degrees of the digital filters 33, 39, respectively. A time function generator 46 receives the ON/OFF timing signal OND and the initial touch data ITD, and output terminals thereof are connected to those of multipliers 34, 40 and 45. The time function generator 46 operates based on the ON/OFF timing signal OND and the initial touch data ITD for generating different level control signals EL, NL and DL. The signal EL has a waveform (c) of FIG. 10, effective to control the step signal level through the multiplier 34. The signal NL has a waveform (b) of FIG. 10, effective to control the noise signal level through the multiplier 40. The signal DL has a waveform (d) of FIG. 10, effective to control a level of a direct signal DIRI through the multiplier 45. The direct signal DIR1 is provided from the second data converter 43, and is therefore responsive to the right elbow bending speed RES.

An output terminal of the adder 35 is connected to the tone generator 23 (not shown) through a multiplier 36 and an adder 37. The adder 37 produces an excitation signal of the tone generator 23 in the form of the mouth pressure signal PRES. A low frequency oscillator (LFO) 47 is connected to the multiplier 36 through a multiplier 48 and an adder 50. A fourth data converter (TBL4) 49 is connected to the multiplier 48. The fourth data converter 49 receives the right wrist bend angle RWD, and feeds a control signal to the multiplier 48 according to RWD. The adder 50 receives a signal indicative of value "1". A fifth data converter (TBL5) 51 receives the left wrist bending speed LWS, and its output terminal is connected to the adder 37. The fifth data converter 51 feeds to the adder 37 a control signal according to LWS.

Figure 10:
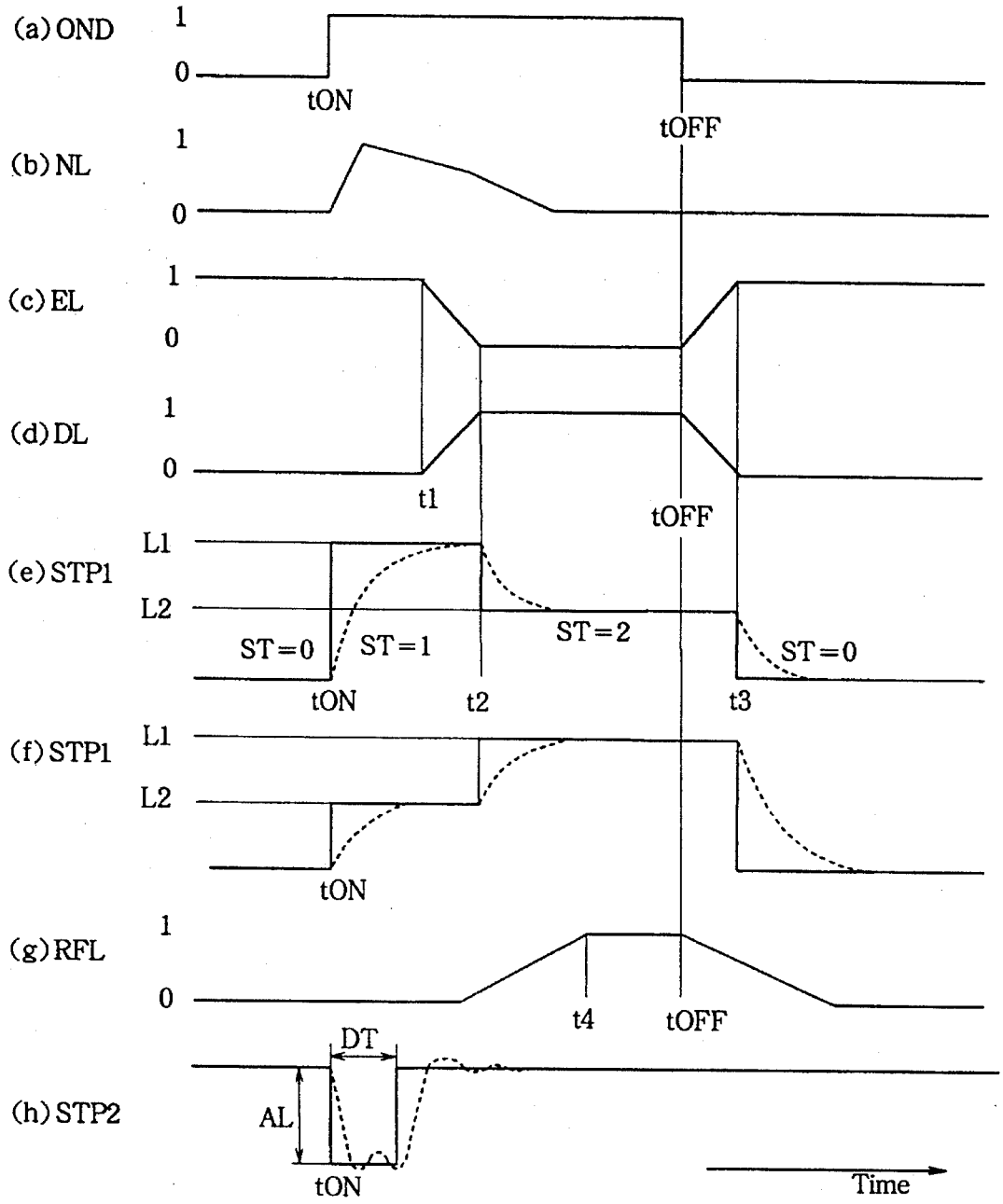
FIG. 10 is a timing chart showing operation of the first and second envelope generators.

Next, the description is given for the operation of the thus constructed first envelope generator 21 with reference to FIG. 10. The step function generator 31 outputs the step signal STP1 as indicated by the solid line of the FIG. 10 waveform (e). The digital filter 33 outputs the filtered step signal STP 1 as indicated by the dashed line of the FIG. 10 waveform (c). This step signal STP I is multiplied by the level control signal EL having the waveform (c) by means of the multiplier 34. The multiplied result is inputted into the adder 35. The level control signal EL is held at value "0" between the intermediate timing t2 and the OFF-timing tOFF, hence the step signal STP 1 is not inputted into the adder 35 in this time interval t2-IOFF. Therefore, the step signal STPI contributes to the final mouth pressure signal PRES during a leading time interval tON-t2 and a trailing time interval tOFF-t3. The sixth data converter 42 outputs a signal according to the direct signal DIR1 when the state signal ST inputted from the step function generator 31 has the value "1" or "2", thereby imparting to the amplitude of the step signal STP1 a variation according to the right elbow bending speed RES. In this case, contribution degree of the direct signal DIR1 is regulated according to the value of the state signal ST.

On the other hand, the white noise signal outputted from the random signal generator 38 is processed by the digital filter 39 to extrude desired frequency band components. The processed noise signal is multiplied by the level control signal NL by means of the multiplier 40. The multiplied result is inputted into the adder 35. As shown in the waveform (b), the noise level control signal NL has an effective value above "0" only in an initial part of a given time interval during which the ON/OFF timing signal is held at value "1", hence the noise signal is added only to a leading part of the musical tone. Further, the direct signal DIRI is multiplied by the level control signal DL at the multiplier 45, and the multiplied result is inputted into the adder 35. As shown by the waveform (d), the control signal DL takes value "1" during a certain time interval t2-tOFF, hence the direct signal DIR1 can contribute significantly to a sustain state of the mouth pressure signal PRES when the musical tone is continuously generated.

The output signal of the adder 35 is added with vibrato by means of the multiplier 36, and is further added with a signal according to the left wrist bending speed LWS by means of the adder 37, thereby producing the final mouth pressure signal PRES. Namely, the output signal of the low frequency oscillator 47 is multiplied by a signal according to the right wrist bend angle RWD, and the multiplied result is added with the value "1". The added result is fed to the multiplier 36. By this operation, the vibrato or periodical vibration of breathing pressure is realized in desired depth according to the fight wrist bend angle RWD. Further, the left wrist bending speed LWS is fed to the adder 37 to impart a natural wave full of variety in response to flexional action of the left hand wrist.

Figure 11:
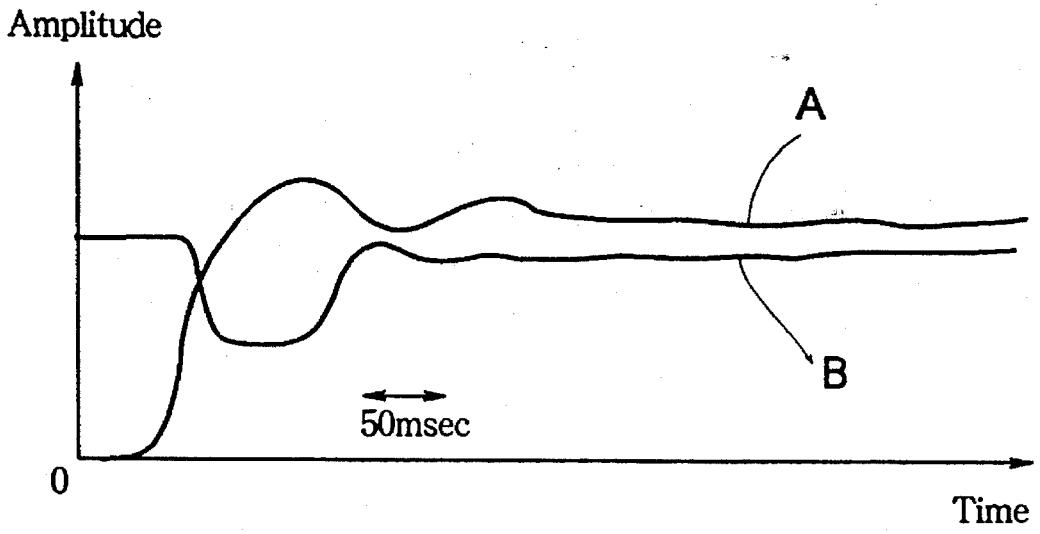
FIG. 11 is a diagram showing typical waveforms of a mouth pressure signal and an embouchure signal.

A curve A of FIG. 11 shows a typical envelope waveform of the mouth pressure signal PRES outputted from the first envelope generator 21. This waveform is synthesized in response to the body action of the player. In order to well express the player's body action, the respective control parameters and input/output characteristics of the respective data converters are set optimumly. In operation of the first envelope generator 21, contribution of the output from the step function generator 21 is boosted in the leading section of the musical tone, which requires a quick variation, hence there can be obtained the mouth pressure signal PRES effective to enable realistic musical expression representative of relatively quick action such as the mouth action in playing a wind instrument, which could not be simulated by the hand and arm action. On the other hand, in the sustaining part of the musical tone, contribution of the body action in terms of the right elbow bending speed RES etc. is increased, hence there can be obtained the mouth pressure signal PRES effective to enable realistic expression in response to the body action. In modification, the step function generator 31 may produce a step signal having a stepwise waveform (f) of FIG. 10.

Figure 9:
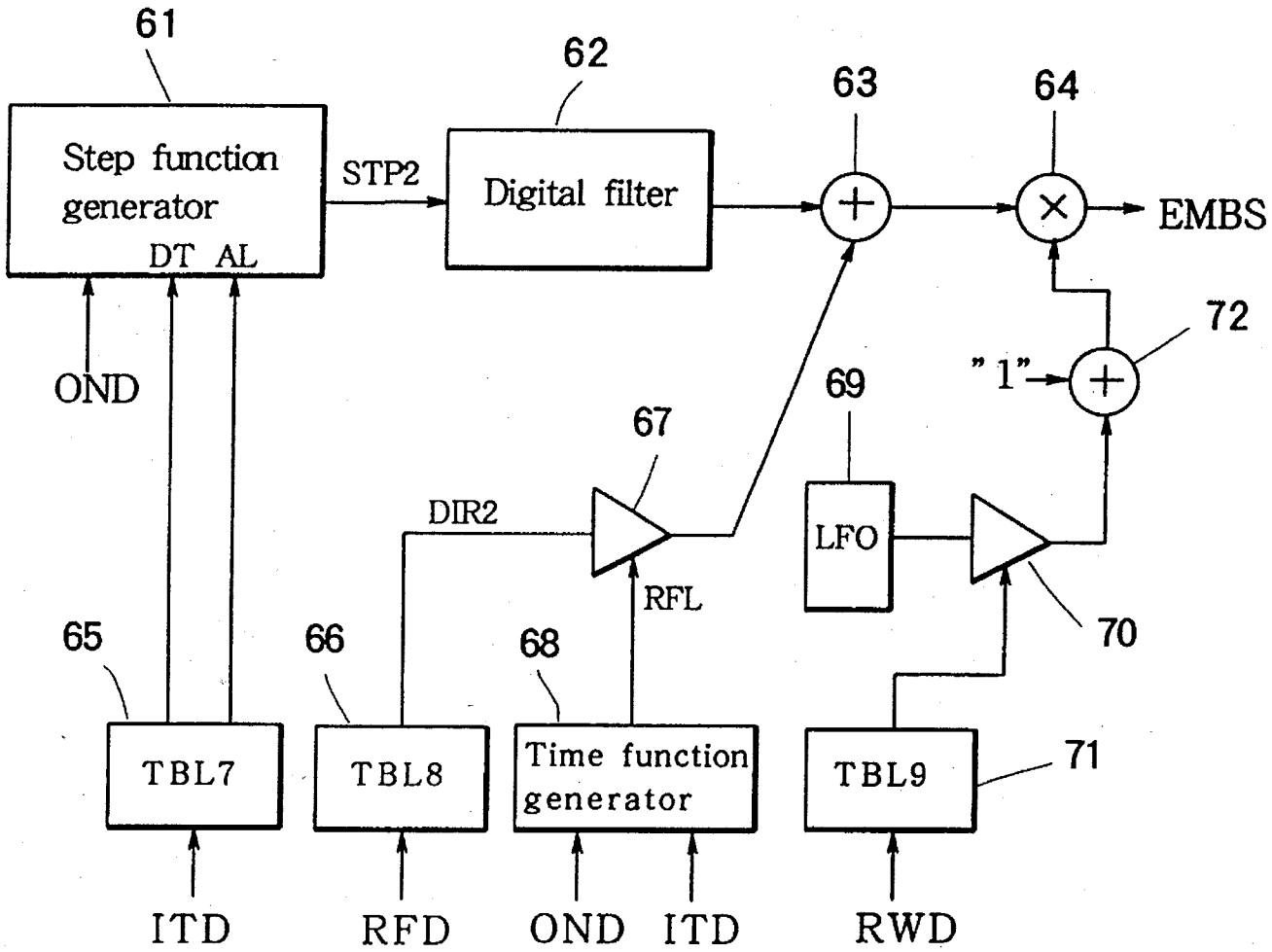
FIG. 9 is a block diagram showing construction of a second envelope generator (EG2).

Next, the description is given for the second envelope generator 22 with reference to FIG. 9. In the figure, the envelope generator 22 is provided with a step function generator 61 which generates a time-varying signal in the form of a step signal STP2 indicated by the solid line of a waveform (h) of FIG. 10. Its output terminal is connected to an adder 63 through a digital lowpass filter 62. The step function generator 61 receives directly the ON/OFF timing signal OND, and is fed with control parameters DT and AL from a seventh data converter (TBL7) 65. The seventh data converter 65 is inputted with the initial touch data ITD to determine the values of control parameters DT and AL according to the ITD value. The control parameters DT and AL are effective to determine, respectively, an amplitude and a duration of the step signal STP2 as shown in the waveform (h) of FIG. 10. An eighth data converter (TBL8) 66 receives the right thumb pressure RFD, and its output terminal is connected to the adder 63 through a multiplier 67. The eighth data converter 66 produces a direct signal DIR2 in response to the right thumb pressure RFD. A time function generator 68 is inputted with the ON/OFF timing signal OND and initial touch data ITD, and its output terminal is connected to the multiplier 67. The time function generator 68 outputs a level control signal RFL having a waveform (g) of FIG. 10, effective to control a level of DIR2. An output terminal of the adder 63 is connected to the tone generator 23 (not shown) through a multiplier 64. The multiplier 64 outputs another excitation signal of the tone generator 23, in the form of the embouchure signal EMBS. A low frequency oscillator (LFO) 69 is connected to the multiplier 64 through a multiplier 70 and an adder 72. A ninth data converter (TBL9) 71 is connected to the adder 70. The ninth data converter 71 is inputted with the right wrist bend angle RWD to feed a signal according to RWD to the multiplier 70. The adder 72 receives a signal indicative of value "1".

Next, the description is given for the operation of the thus constructed second envelope generator 22. The step function generator 61 outputs the step signal STP2 as indicated by the solid line of the waveform (h) of FIG. 10. The digital filter 62 processes the step signal STP2 to form a shaped waveform (h) indicated by the dashed line. This processed step signal STP2 is applied to the adder 63. Further, the direct signal DIR2 is multiplied with the level control signal RFL by the multiplier 67, and the multiplied result is inputted into the adder 63. The level control signal RFL takes the value "1" during a time interval t4-tOFF as shown in the waveform (g), hence the direct signal DIR2 contributes significantly to a sustain state of the embouchure signal EMBS while the musical tone is continuously generated. An output signal of the adder 63 is added with a vibrato by the adder 64, thereby forming the embouchure signal EMBS. An output signal of the low frequency oscillator 69 is multiplied with the signal according to the right wrist bend angle RWD, and is further added with the value "1". The result is applied to the multiplier 64. By such an operation, the vibrato is added in a desired depth according to RWD.

A curve B of FIG. 11 shows a typical waveform of the embouchure signal EMBS. The respective control parameters and input/output characteristics of the data converters are suitably set so as to obtain a desired waveform of EMBS in response to the body action of the player. In manner similar to the first envelope generator 21, the second envelope generator 22 can generate the embouchure signal EMBS effective to enable realistic expression of a rapidly varying part of the musical tone such as an attack section, due to increase in contribution of the output of the step function generator 61. Stated otherwise, the step function generator 61 represents a quick action such as mouth motion in playing of a wind instrument, which would not be expressed by action of hands and arms. On the other hand, in a sustain part of the musical tone, the body action particularly represented by variation of the right thumb pressure RFD greatly contributes to the embouchure signal EMBS to thereby enable vivid expression directly responsive to the player's action.

Figure 12:
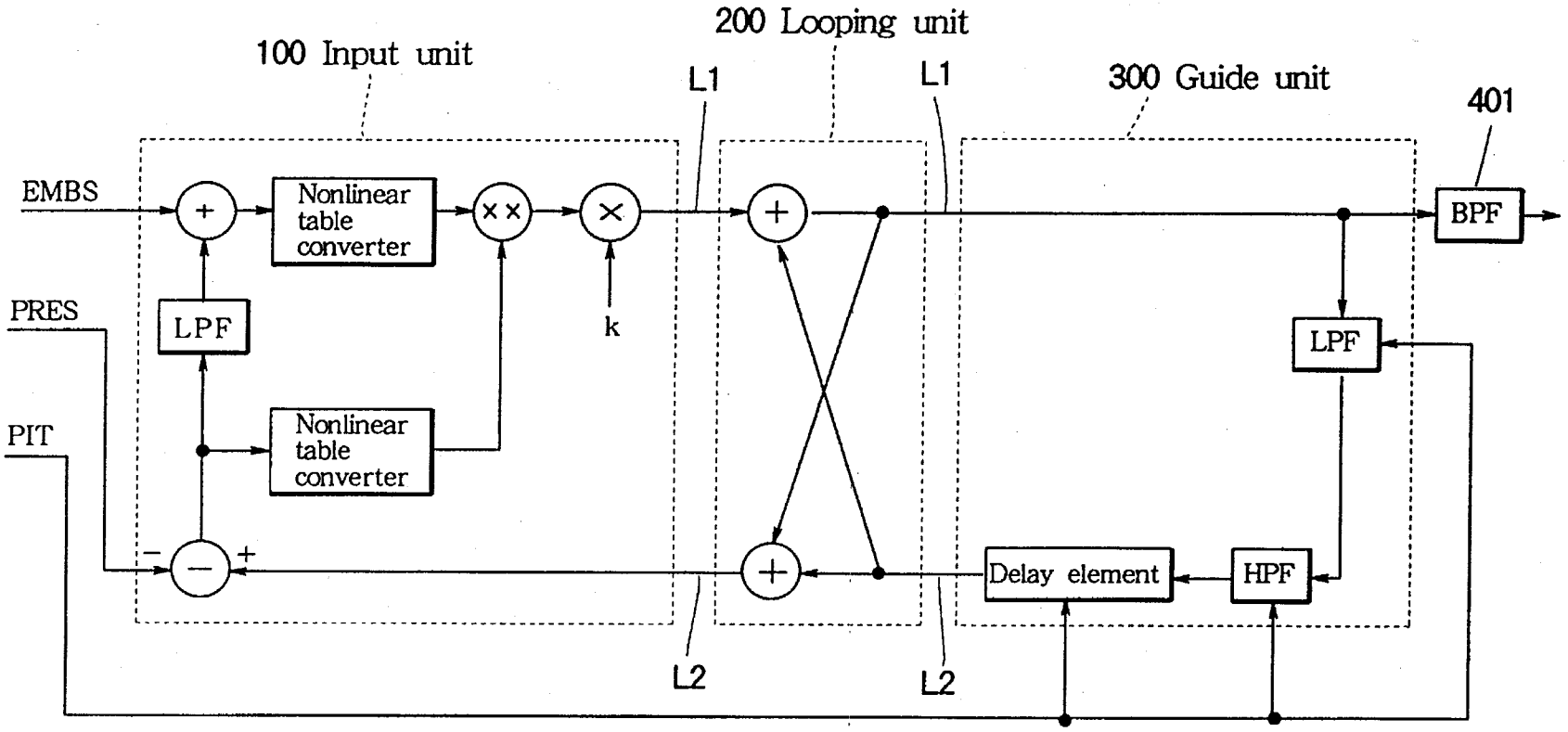
FIG. 12 is a block diagram showing construction of a tone generator provided in the FIG. 1 electronic musical instrument.

FIG. 12 is a block diagram showing construction of the tone generator 23 of the delayed feedback type. The tone generator 23 is comprised of an input unit 100 for receiving a musical tone control signal in the form of excitation signals such as PRES and EMBS, a looping unit 200 for looping a wave signal based on the excitation signals through a teed back path L1, L2, a guide unit 300 for guiding the wave signal, and an output bandpass filter (BPF) 401, thereby generating the wave signal of a musical tone simulative of reed instruments such as clarinet and saxophone. The input unit 100 is comprised of a lowpass filter (LPF), nonlinear table converters and so on for simulating a mouth-piece of the reed instrument. The input unit 100 receives the mouth pressure signal PRES and the embouchure signal EMBS from the first and second envelope generators 21, 22, respectively. The looping unit 200 is constructed to simulate a junction between the mouth-piece and a succeeding reed. The guide unit 300 is comprised of a lowpass filter (LPF), a highpass filter (HPF) and a delay element for simulating a resonant tube of the reed instrument. The guide unit 300 receives from the tone pitch register the tone pitch data PIT effective to adjust characteristics of these lowpass filter, highpass filter and delay element, thereby forming a musical tone signal having a desired pitch. The bandpass filter 401 is provided to simulate a radiation characteristic of a musical tone in air. An output signal of the tone generator 23 is transmitted from the bandpass filter 401. By such a construction, the tone generator 23 is excited by the mouth pressure signal PRES and the embouchure signal EMBS to generate the musical tone signal having a pitch according to the tone pitch data PIT. More detailed construction of such a tone generator is disclosed in Japanese Patent Application Laid-open No. 194692/1990.

As described above, in the embodiment of the invention, the tone generator is composed of a digital circuit simulative of a reed wind instrument. The tone generator is excited by excitation signals responsive to the player's body action which is detected by various sensors attached to joints of fingers, wrists and elbows. The tone generator can be efficiently operated to the full extent of its synthesis ability to thereby enable desired artistic expression. Further, the excitation signal is formed of a composite of action signals representative of the body action and a step signal outputted from the step function generator, thereby enabling vivid music expression associated to quick action of mouth and lip, which could not be represented by the action signal alone. In modification, the FIG. 1 construction may be added with panel switches and a display for use in set and selection of timbre, tone color edit and so on. Though the present embodiment exemplifies an electronic musical instrument simulating the wind instrument, the invention can be applied to another type of the electronic musical instrument simulative of a stringed instrument. The tone generator may be composed of another delayed feedback type. Moreover, the invention is not limited to the above exemplified relation between the player's body action and the control parameters such as tone pitch data PIT and ON/OFF timing signal OND. There may be adopted various modifications such as functions of right and left hands can be exchanged. For summary, according to the invention, the tone generator of the delayed feedback type is excited by the excitation signal responsive to the body action. The tone generator can be efficiently operated to the full extent of its synthesis ability, thereby enabling musical performance containing sophisticated artistic expression. Further, the step function generator is provided to produce a time-varying signal in the form of a step signal which represents a quick and delicate action of mouth and lip which could not be replaced by arm and hand action. The time-varying stepwise signal and the body action signal are superposed with one another to synthesize the excitation signal. The tone generator of the delayed feedback type is excited by the synthesized excitation signal to thereby improve variety of the performance as well as to enable impressive performance.

What is claimed is:

1. An electronic musical instrument comprising:

detecting means for detecting body action to produce an action signal representative of the detected body action, the detecting means including sensor means worn by a player on a part of the player's body for detecting the body action of the part;

excitation means for producing an excitation signal according to the action signal, wherein the excitation means includes timing means responsive to the action signal for producing a timing signal indicative of at least one of initiation and termination of the musical tone signal, function means responsive to the timing signal for producing a time-varying signal which varies according to the at least one of initiation and termination of the musical tone signal, and synthesis means for processing the time-varying signal based on the action signal so as to form an excitation signal effective for exciting the tone generator means;

pitch means for designating a desired tone pitch; and tone generator means of a delayed feedback type receptive of the excitation signal for generating a musical tone signal according to the designated tone pitch, the tone generator means including delay means for delaying the excitation signal by a given time corresponding to the designated tone pitch, and feedback means for feeding back the delayed excitation signal to the delay means.

2. An electronic musical instrument according to claim 1; wherein the sensor means includes a flexible sensor element positioned around a desired joint part of the player's body for detecting a bend angle thereof representative of the body action.

3. An electronic musical instrument according to claim 1; wherein the pitch means includes means connected to the detecting means for designating a tone pitch according to a sequence of the detected body action.

4. An electronic musical instrument comprising:

detecting means for detecting body action of a player to produce an action signal indicative of the detected body action;

pitch means for designating a given pitch of a musical tone;

timing means for producing a timing signal indicative of at least one of initiation and termination of a musical tone;

function means responsive to the timing signal for producing a time-varying signal which varies during generation of a musical rode after the initiation of the the musical tone;

synthesis means for processing the time-varying signal based on the action signal so as to form an excitation signal; and tone generator means of a delayed feedback type excited by the excitation signal for generating a tone signal representative of the musical tone according to the designated pitch, the tone generator means including delay means for delaying the excitation signal by a given time corresponding to the designated pitch, and feedback means for feeding back the delayed excitation signal to the delay means.

5. An electronic musical instrument according to claim 4; wherein the detecting means includes sensor means directly attached to a given part of the player's body for detecting the body action of that part.

6. An electronic musical instrument according to claim 4, wherein the detecting means includes sensor means worn by a player on a part of his or her body, and the sensor means detects the body action of the part.

7. An electronic musical instrument comprising:

detecting means for detecting body action of a player to produce an action signal indicative of the detected body action;

pitch means for designating a given pitch of a musical tone;

timing means for producing a timing signal indicative of at least one of initiation and termination of a musical tone;

function means responsive to the timing signal for producing a time-varying signal which varies according to the at least one of initiation and termination of a musical tone, wherein the function means comprises a step function generator for generating a time-varying signal which varies in a stepwise fashion with a lapse of time, and the synthesis means includes modifying means for modifying the time-varying signal according to the action signal;

synthesis means for processing the time-varying signal based on the action signal so as to form an excitation signal; and tone generator means of a delayed feedback type excited by the excitation signal for generating a tone signal representative of the musical tone according to the designated pitch, the tone generator means including delay means for delaying the excitation signal by a given time corresponding to the designated pitch, and feedback means for feeding back the delayed excitation signal to the delay means.

8. An electronic musical instrument comprising:

detecting means for detecting body action to produce an action signal representative of the detected body action, the detecting means including sensor means worn by a player on a part of the player's body for detecting the body action of the part;

excitation means for producing an excitation signal according to the action signal, wherein the excitation means includes a noise generator which generates a noise signal, which is included in the excitation signal, and wherein a characteristic of the noise signal is controlled in response to the action signal;

pitch means for designating a desired tone pitch; and tone generator means of a delayed feedback type receptive of the excitation signal for generating a musical tone signal according to the designated tone pitch, the tone generator means including delay means for delaying the excitation signal by a given time corresponding to the designated tone pitch, and feedback means for feeding back the delayed excitation signal to the delay means.

9. An electronic musical instrument comprising:

detecting means for detecting body action to produce an action signal representative of the detected body action, the detecting means including sensor means worn by a player on a part of the player's body for detecting the body action of the part;

excitation means for producing an excitation signal according to the action signal, wherein the excitation means includes a low frequency oscillator which generates an output signal so as to impart a vibration effect corresponding to the output signal into the excitation signal, and wherein the vibration effect is controlled in response to the action signal;

pitch means for designating a desired tone pitch; and tone generator means of a delayed feedback type receptive of the excitation signal for generating a musical tone signal according to the designated tone pitch, the tone generator means including delay means for delaying the excitation signal by a given time corresponding to the designated tone pitch, and feedback means for feeding back the delayed excitation signal to the delay means.

10. An electronic musical instrument comprising:

detecting means for detecting body action to produce an action signal representative of the detected body action, the detecting means including sensor means worn by a player on a part of the player's body for detecting the body action of the part;

excitation means for producing an excitation signal according to the action signal, wherein the excitation means includes a differentiation means for differentiating the action signal so as to control the excitation signal in response to the differentiated result of the action signal;

pitch means for designating a desired tone pitch; and tone generator means of a delayed feedback type receptive of the excitation signal for generating a musical tone signal according to the designated tone pitch, the tone generator means including delay means for delaying the excitation signal by a given time corresponding to the designated tone pitch, and feedback means for feeding back the delayed excitation signal to the delay means.

11. An electronic musical instrument, comprising:

detecting means for detecting a plurality of body actions so as to produce a plurality of action signals corresponding thereto, the detecting means including sensor means worn by a player on a part of the player's body for detecting the body action of the part;

excitation means for producing an excitation signal based on the plurality of action signals;

pitch means for designating a desired tone pitch; and tone generator means of a delayed feedback type receptive of the excitation signal for generating a musical tone signal according to the designated tone pitch, the tone generator means including delay means for delaying the excitation signal by a given time corresponding to the designated tone pitch, and feedback means for feeding back the delayed excitation signal to the delay means.

* * * * *